US006595589B2

(12) United States Patent
Cochran

(10) Patent No.: US 6,595,589 B2
(45) Date of Patent: Jul. 22, 2003

(54) PORTABLE THERAPY CHAIR

(76) Inventor: Charles A. Cochran, 238 Cir. Dr. E, St. Augustine, FL (US) 32084

( * ) Notice: Subject to any disclaimer, the term of this patent is extended or adjusted under 35 U.S.C. 154(b) by 0 days.

(21) Appl. No.: 09/855,098

(22) Filed: May 15, 2001

(65) Prior Publication Data

US 2002/0171281 A1 Nov. 21, 2002

(51) Int. Cl.[7] ..... A47C 7/50

(52) U.S. Cl. ..... 297/423.11; 297/16.2; 297/195.11

(58) Field of Search ..... 297/423.11, 423.1, 297/16.2, 16.1, 19, 24, 25, 27, 46, 47, 48, 22, 55, 344.1, 195.11

(56) References Cited

U.S. PATENT DOCUMENTS 1,685,599 A * 9/1928 Fletcher
3,669,493 A * 6/1972 Vowles
4,746,167 A * 5/1988 Palmer et al.
4,943,117 A * 7/1990 Brown
5,401,078 A 3/1995 Riach
5,538,011 A * 7/1996 Craft et al.
5,971,485 A * 10/1999 Clark
6,065,808 A * 5/2000 Tinsley
6,186,593 B1 * 2/2001 Garneau

* cited by examiner

*Primary Examiner*—Peter M. Cuomo
*Assistant Examiner*—Stephen Vu
(74) *Attorney, Agent, or Firm*—Robert O. Wright

(57) ABSTRACT

A portable, light weight therapy chair is shown which folds flat into an easily carried apparatus when not in use and which may be easily set up and taken down at a patient's location. The arrangement of multiple pairs of two pivotally joined arms results in a safe and stable apparatus.

12 Claims, 6 Drawing Sheets

PORTABLE THERAPY CHAIR

This invention relates to chairs used for seating patients for treatment by therapists and more particularly to portable treatment chairs that may be quickly and easily folded into a compact, easily carried condition facilitating use of the device for in home treatment of patients.

BACKGROUND OF THE INVENTION

For many years adjustable and folding chairs for use by therapists in treating patients with physical ailments and emotional and physical stress have been available. More recently with the emphasis on in home or office treatment, the need for light weight, foldable, easily set up and taken down, yet rugged and very stable chairs has become apparent. Various prior art devices have been suggested over the years but have been relatively heavy with limited adjustability and have been difficult to break down into easily carried and transportable form. A good discussion of the prior art is set forth in U.S. Pat. No. 5,401,078.

There thus exists a need for a portable therapy chair that can be quickly and easily folded into a compact form that may be easily carried by one person in one hand and readily placed in a car or other vehicle for transportation to the patient's place of treatment.

OBJECTS AND SUMMARY OF INVENTION

It is therefore an object of the invention to provide a portable therapy chair that overcomes the limitations of the prior art.

It is another object of the present invention to provide a therapy chair that is light weight yet may be folded flat, within the plane of the main frame of the chair, for carrying somewhat in the fashion of a brief case in one hand by a therapist.

It is a further object of the present invention to provide a lightweight portable therapy chair that when set up is stable and safe to use for patient treatment.

It is a still further object of the present invention to provide a lightweight, portable, and foldable therapy chair that has three sets of pairs of pivotally connected arms which are in turn pivotally joined at one end to the frame of the chair to form legs seat, knee, and arm rests for the patient and yet may be folded flat within the chair frame for stowage and transport.

It is yet a further object of the present invention to provide a lightweight, portable and foldable therapy chair that uses a minimum number of standard parts to provide a safe and comfortable seating for a patient during treatment.

These and other and further objects are achieved in one embodiment of the invention in which a an elongated pair of frame members are joined together by at least two cross members and have three sets of pivotally joined arms pivotally mounted at one end on said frame members together with another pair of arms pivotally mounted adjacent one end of said frame member and joined by a cross member, to form support legs, seat, arm chest, and head rest portions for a patient during treatment.

BRIEF DESCRIPTIONS OF THE DRAWINGS

The various features, advantages and other uses of the present invention will become more apparent by referring to the following detailed description and drawings in which.

DESCRIPTION OF A PREFERRED EMBODIMENT

Figure 1:
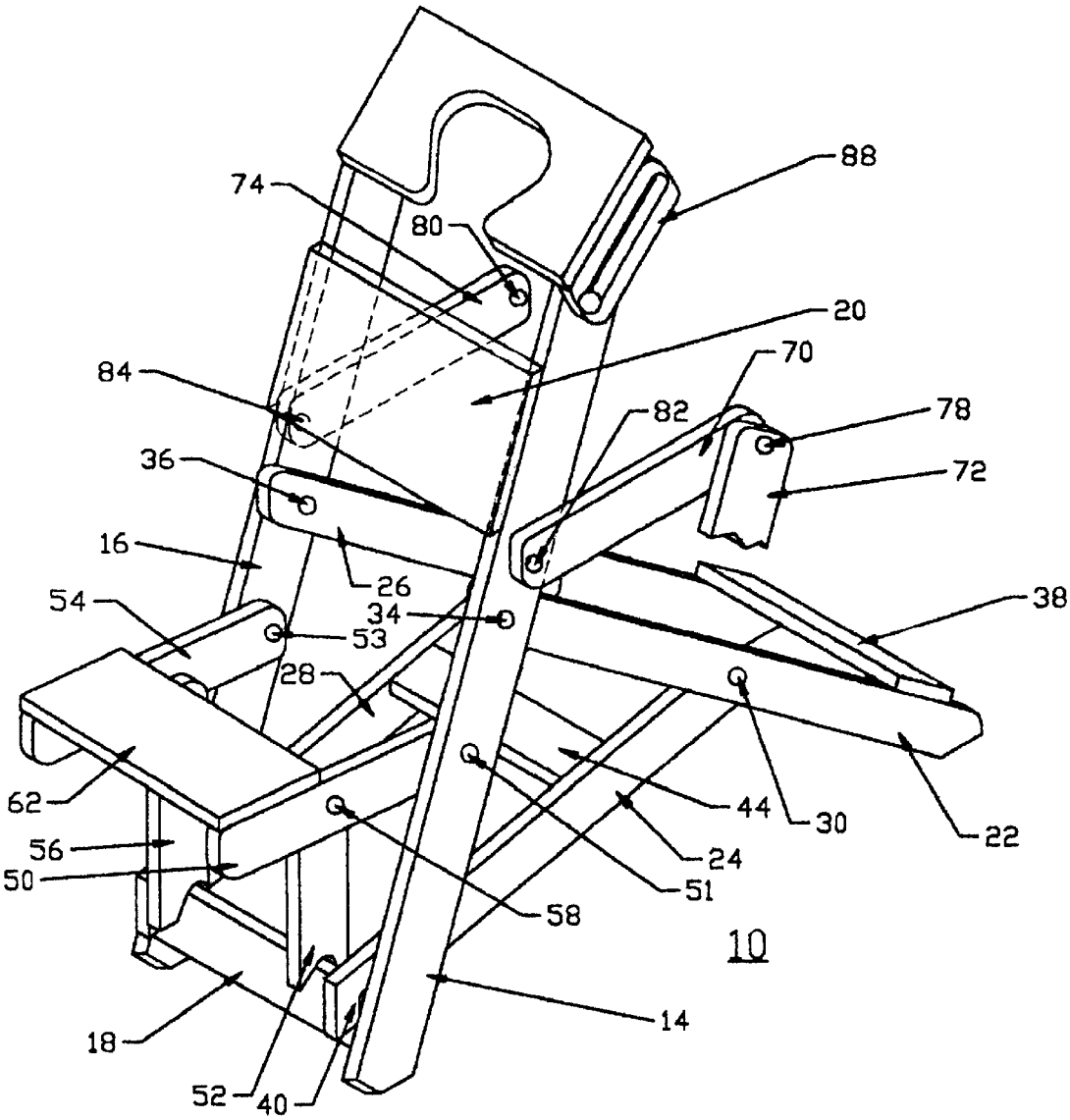
FIG. 1 is a perspective of a portable therapy chair according to the present invention with arm rest and knee rest members omitted for clarity.
Figure 2:
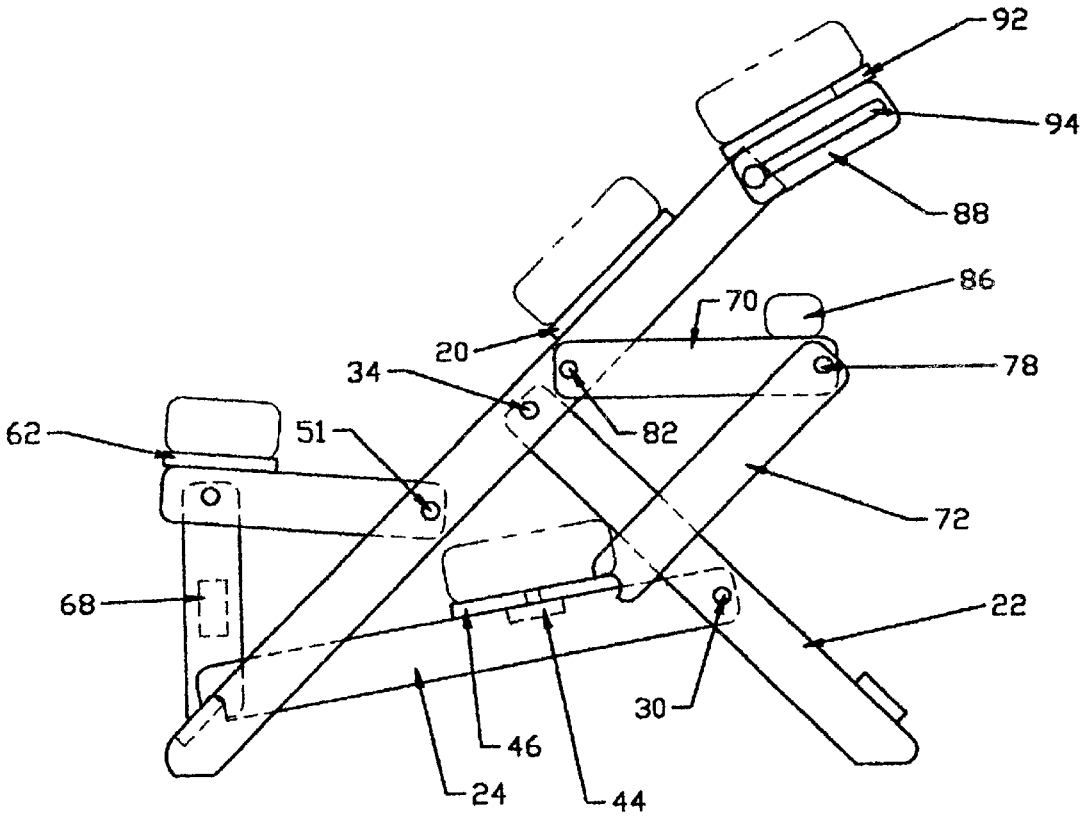
FIG. 2 is a side elevation of the chair of FIG. 1.
Figure 3:
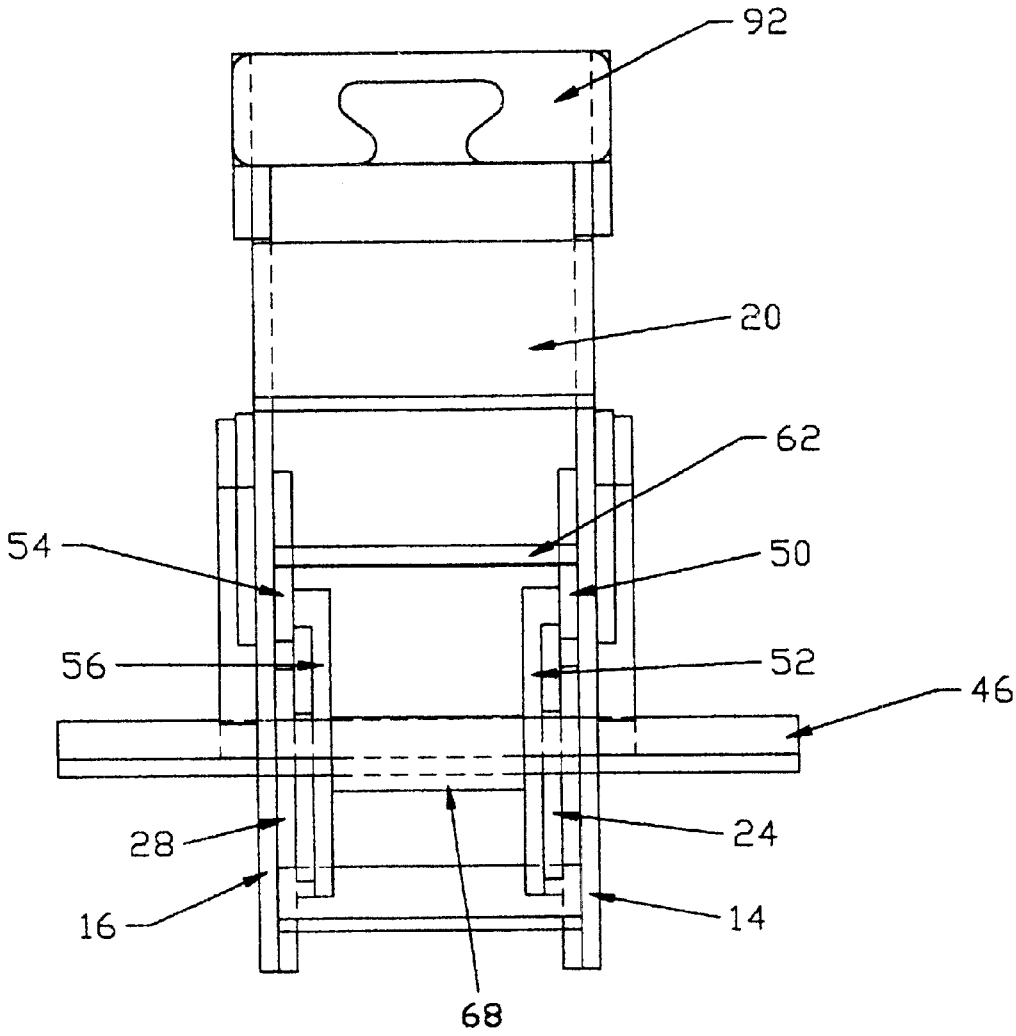
FIG. 3 is an end view of the chair of FIG. 2 taken from the seat side of the chair.

Referring now to FIGS. 1 and 2 there is shown a therapy treatment chair 10. The customary cushions for such a chair are shown in phantom in FIG. 2 only for the sake of clarity. Chair 10 has an elongated frame 12 formed by a pair of side frame members 14 and 16 joined by a foot cross member 18 adjacent one end and a chest support cross member 20 mounted somewhat more than halt way toward the other end of frame 12 from cross member 18. The side members 14 and 16 extend from adjacent foot cross member 18 forming one of the legs of the set up chair, to adjacent the head rest of the chair.

Figure 4:
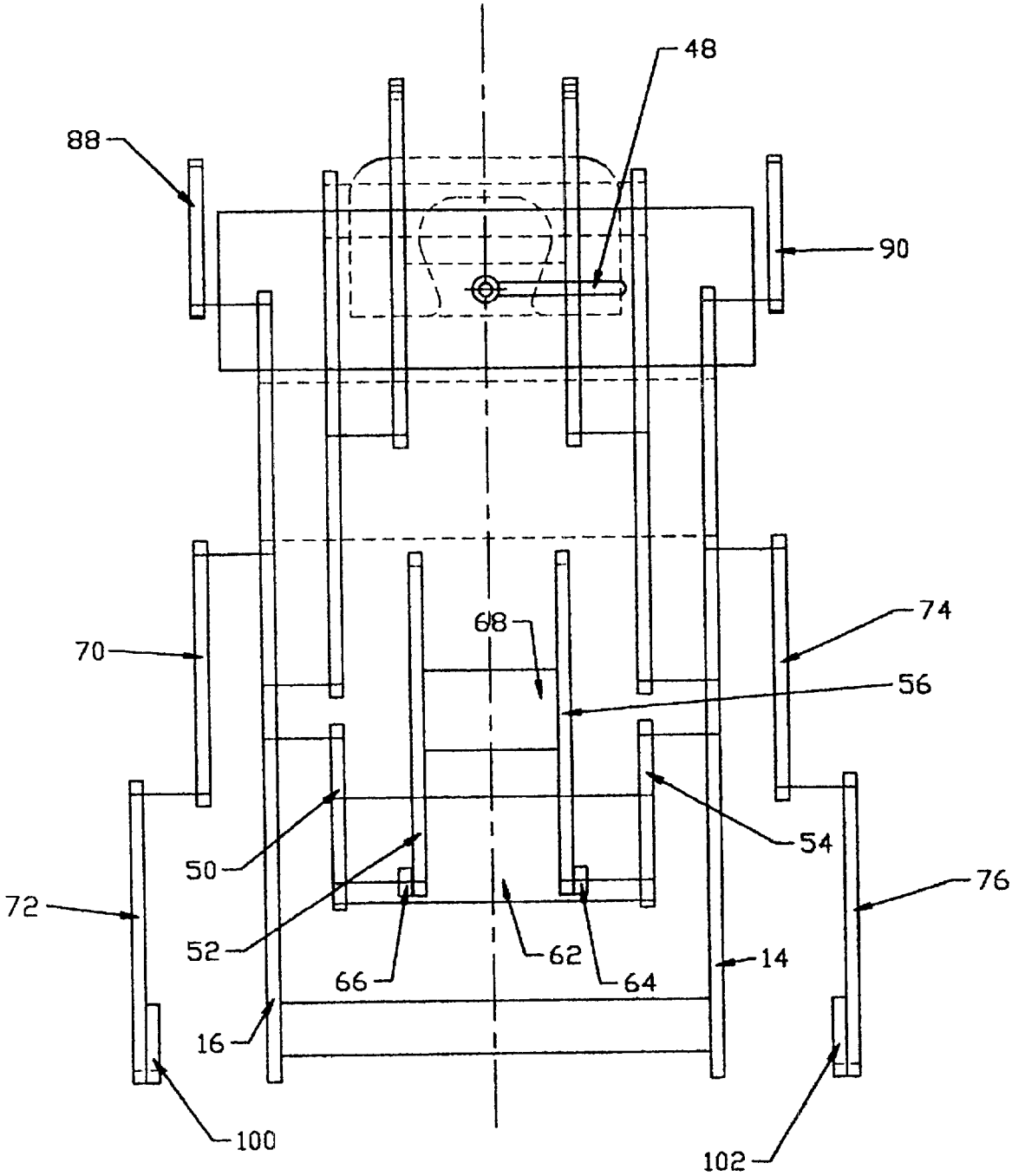
FIG. 4 is an exploded plan view of a partially folded chair taken from the leg side of the chair frame.
Figure 5:
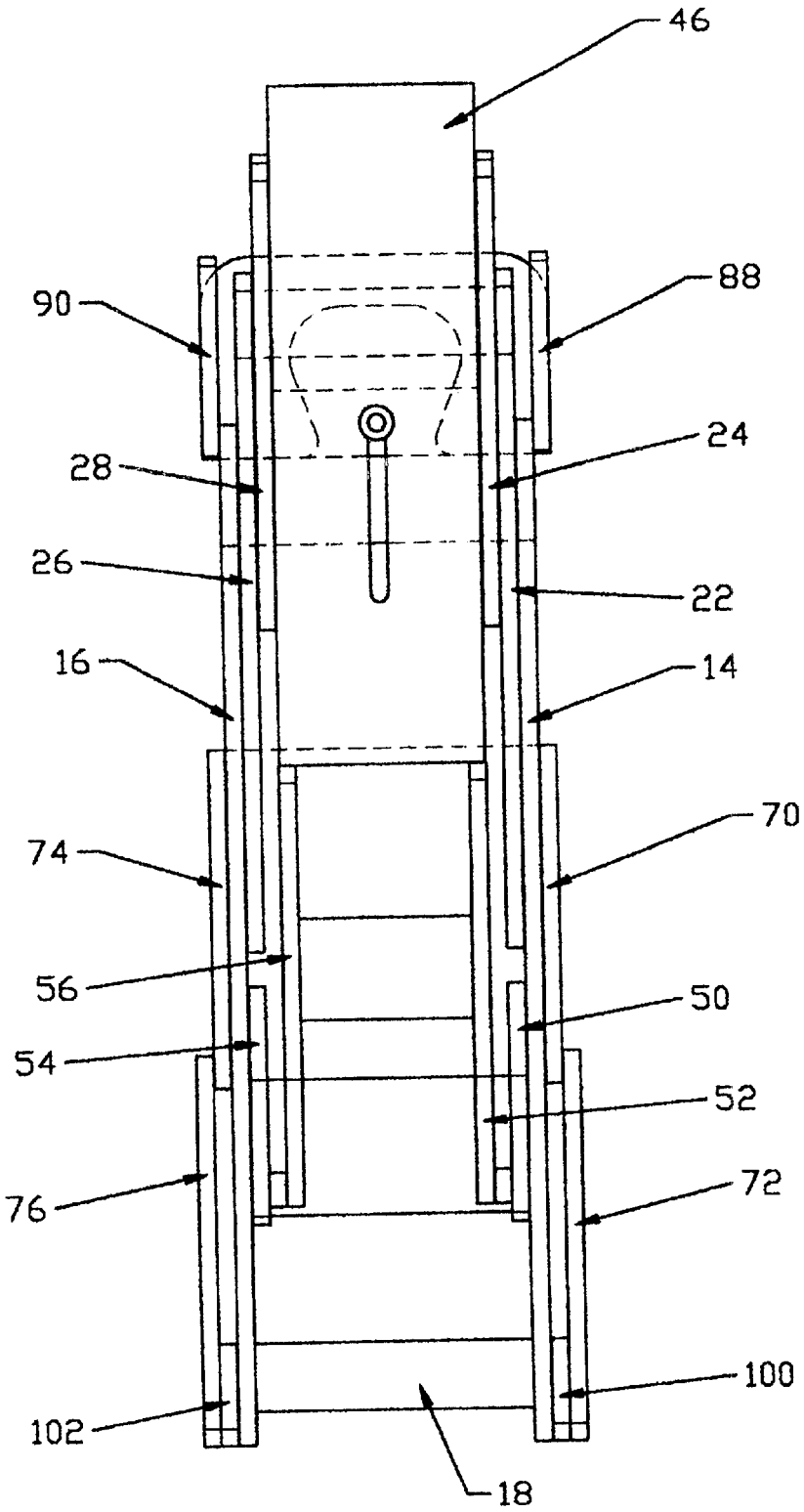
FIG. 5 is a plan view of a completely folded chair taken from the leg side of the chair frame.

A first pair of two pivotally joined arms 22 and 24 and 26 and 28 are pivotally joined together at 30 and 32 respectively to form the second leg of the set up chair. Arms 22 and 26 at one end are pivotally mounted to the inside of frame side members 14 and 16 at 34 and 36 respectively. The other ends of arms 22 and 26 are joined by frame leg cross member 38 to form the second leg for the chair 10. Arms 24 and 28 in the unfolded state extend from pivot points 30 and 32 to engage the foot cross member 18 adjacent the foot of the chair leg formed by side members 14 and 16. Slots 40 and 42 are formed in the free ends of arms 24 and 28 and sized to lock over the edge of foot cross member 18 so as to secure the legs of the chair in weight supporting position. A spacer cross member 44 is fixed between arms 24 and 28 a short distance from pivot points 30 and 32. Knee rest member 46 is pivotally mounted on spacer cross member 44 so as to extend outwardly from the side members 14 and 16 in the unfolded position and when rotated ninety degrees in the folded position to lie within the frame members 14 and 16 (See FIGS. 2,4 & 5). A suitable slot 48 may be provided in knee rest member 46 to assist in proper positioning of said knee rest member 46.

A second pair of seat supporting arms 50, 52 and 54,56 are pivotally joined together at 58,60 respectively. The free ends of arms 50 and 54 are pivotally mounted on the inside of frame side member 14 and 16 slightly below (or toward foot cross member 18) pivot points 34 and 36 at points 51 and 53. The other ends of arms 50 and 54 are joined by seat cross member 62. Arms 52 and 56 are spaced inwardly from arms 50 and 54 by spacers 64 and 66 and are joined adjacent the free ends thereof by seat leg cross member 68. The free ends of arms 52 and 56 are notched to fit over foot cross member 18 and form the vertical support for seat 62 when in the full, unfolded position.

A third pair of arms 70,72 and 74,76 are pivotally joined at 78 and 80 respectively. The free ends of arms 70,74 are pivotally joined to the outside of frame side members 14,16 at 82,84 respectively Pivot points 82,84 are positioned slightly above leg pivot points 34,36. The free ends of arms 72,76 are notched to engaged over the edge of knee rest 46 when in the fully set up position. (See FIG. 2). In the folded position the arms 70,72 and 74,76 lie flat against the outside surface of frame side members 14, 16 and extend adjacent to cross member 18 at the ends thereof. Suitable hook and loop means 100 and 102 may be used to secure the free ends of arms 72 and 74 of the third set of two arms in the stored position. In the fully set up position the arms 70 and 74 form attachment points for arm rest cushion 86 (shown in phantom in FIG. 2) which serves as an arm rest for a patient sitting on the chair 10.

A final pair of arms 88 and 90 are pivotally mounted at one end to the outside upper end of frame side members 14 and 16 with the other ends joined by C shaped cross member 92. With a similarly shaped cushion fixed thereon this forms a patient head rest. Suitable slots 94 and 96 are provided in arms 88 and 90 to allow adjustment of the head rest position and angle to suit the particular patient being treated.

Figure 6:
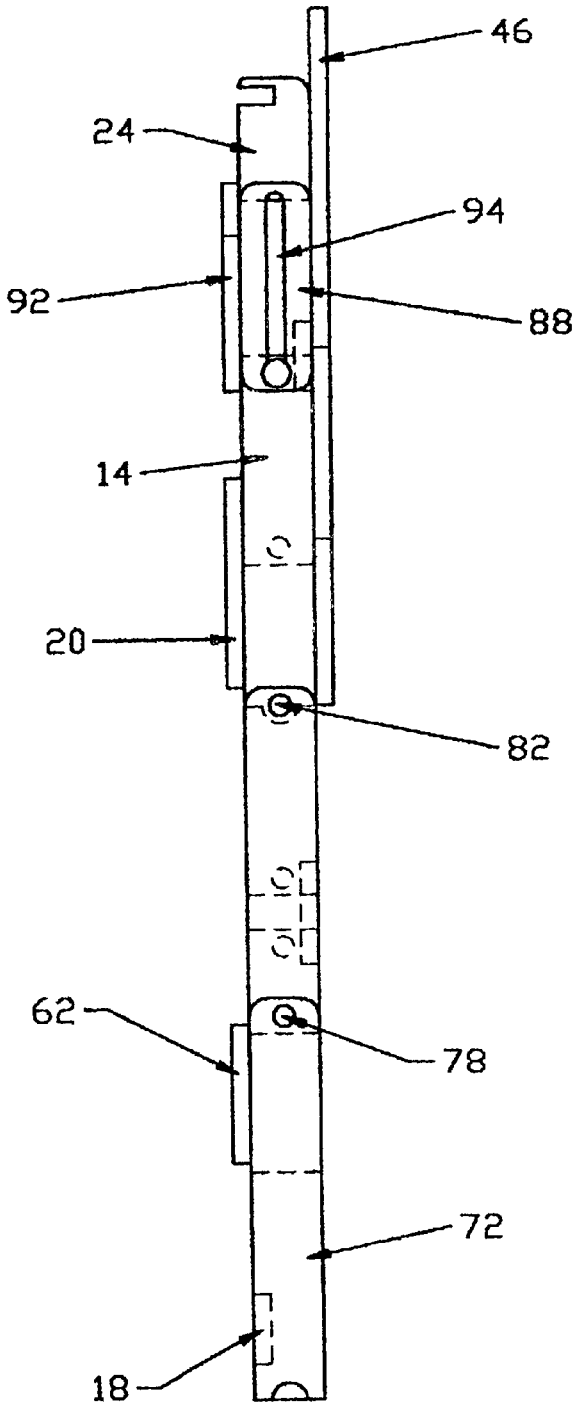
FIG. 6 is and end view of the folded chair of FIG. 5.

In use the portable therapy chair 10 is folded flat as shown in FIG. 6 and placed in a carrying bag (not shown) together with the seat, chest, head, knee, and arm cushions shown in the drawings. A centered handle on the case allows a therapist to easily pick up and carry the entire apparatus to the location of a patient for use in the appropriate treatment. Once on location the bag is removed and the chair set up. The usual sequence starts with the unfolding of the first set of two pairs of arms 22–28 to form a second leg along with the leg formed by frame side members 14 and 16 resulting in a firm, stable foundation for the chair 10. As the arms 24 and 28 are being secured over foot cross member 18 the knee rest 46 may be rotated ninety degrees if desired. For patients with compromised knees the rest member 46 may be left in the folded position. Next the second set of two pairs of seat supporting arms 50–56 are unfolded and the ends of arms 52 and 56 engaged about foot cross member 18 to place seat 62 in operating position. The third set of two pairs of arms 70–76 are unfolded to form, with the arm rest cushion, a place for patients to position their arms. Finally the head rest is adjusted to the desired position and angle. All cushions as desired are installed as shown and the chair is ready for use. Any quick clamping mechanism may be used to securely position the various arms in the desired position. In the embodiment shown a simple carriage bolt with washer and wing nut is used with satisfactory results.

In the typical embodiment shown the frame side members 14 and 16 are made from wood about two and one-half inches wide by three quarters of an inch thick and a length of about forty eight inches. The other arms are made from similar sized wood with various lengths of ten to thirty inches as appropriate. The knee rest member 46 is approximately six inches wide by about twenty seven inches long by the same thickness. The seat, chest support and head rest are formed of plywood approximately one-quarter of an inch thick. The various arms and side members are pivotally joined to each other by carriage bolts, washers and wing nuts for ease of adjustment and pivotal movement. When in the fully folded position as shown in FIG. 6 the arms align with the side members and thus lie within the plane of the chair frame. Only the seat, chest support, head rest on the one side and the knee rest on the other extend outside of the plane of the chair frame. Thus for carrying purposes the chair frame, without cushions, folds into a flat assembly apporximately sixteen inches wide by fifty six inches long and three and one-half inches thick.

Obviously other materials than wood, such as aluminum, various molded laminates and high strength to weight ratio materials such as plastics, carbon fiber, etc. and different cross sectional shapes such as angles, hollow bars, tubing, may be used By maintaining the concept of multiple sets of two pairs of arms pivotally joined together and to a central frame member in proper sequence a therapy chair according to the present invention can be constructed from a variety of materials. The end result is a safe, stable, light weight, easily set up and taken down, therapy chair.

While there are given above certain specific examples of this invention and its application in practical use, it should be understood that they are not intended to be exhaustive or to be limiting of the invention. On the contrary, these illustrations and explanations herein are given in order to acquaint others skilled in the art with this invention and the principles thereof and a suitable manner of its application in practical use, so that others skilled in the art may be enabled to modify the invention and to adapt and apply it in numerous forms each as may be best suited to the requirement of a particular use.

I claim:

1. A unitary, portable and adjustable therapy chair on which a patient is seated to facilitate treatment by a therapist, said chair comprising:

an elongated frame member forming a leg portion at one end and a head rest portion at an opposite end thereof;

said generally rectangular, elongated frame member having first and second side members extending adjacent to said leg portion of said chair and adjacent to said head rest portion of said chair, said side members being connected adjacent to said leg end by a first cross member, and at a longitudinal distance from said first cross member by a second cross member;

a first pair of two spaced apart, pivotally connected arms, wherein each of said first pair having a first arm with a cross member fixed thereto adjacent to one end of said first arm thereof, and another end of said first arm being pivotally mounted to said first and second frame members;

wherein each of said first pair having a second arm having at free ends thereof interconnecting means for selectively engaging with said frame first cross member;

a second pair of two spaced apart, pivotally connected arms, wherein each of said second pair having a first arm with a cross member fixed thereto adjacent to one end thereof, and another end of said first arm being pivotally mounted to said first and second frame members;

wherein each of said second pair having a second arm having at free ends thereof interconnecting means for selectively engaging with said first cross member of said frame;

said first pair of pivotally connected arms forming in an extended position on one side of said first and second side members, a leg member for said therapy chair and in retracted and stored positions lying solely within the lateral confines of said elongated frame side members;

said second pair of pivotally connected arms forming in an extended position on another side of said first and second side members from a side of said leg member, a patient seat for said therapy chair and in the retracted and stored positions lying solely within the lateral confines of said elongated frame side members;

whereby in the extended position said first and second pairs of arms form a stable and comfortable patient chair and in the retracted and stored positions form a thin, easily carried and transportable apparatus for the massage therapist.

2. The chair as claimed in claim 1 wherein said second cross member connecting said first and second side members forms a chest support platform when said chair is in an extended unfolded patient chair position.

3. The chair as claimed in claim 1 further including a cross member connecting said second arms of said first pairs of two, and a knee supporting member pivotally mounted on said cross member for rotation from a longitudinally aligned position with said elongated frame to a transverse position providing support for a knee on either side of said frame when a patient is seated on said patient seat.

4. The chair as claimed in claim 3 further including a third pair of two pivotally connected arms having one end of one arm of each pair pivotally connected to said first and second side members respectively of said elongated frame member, the free end of said second arm of said pivotally connected arms being operatively formed when in an extended position to engage with extended frame to form an arm rest for a patient seated on the chair, and when in the retracted and stored position to lie substantially entirely within the plane of said elongated frame.

5. The chair as claimed in claim 4 wherein said first and second pair of two pivotally connected arms are connected to said first and second side members on an inside surface of said side members, and said third pair of pivotally connected arms are connected to said first and second side members on an outside surface of said side members.

6. The chair as claimed in claim 3 further including a third pair of two pivotally connected arms having one end of one arm pair pivotally connected to said first and second side members respectively of said elongated frame member, the free end of another arm being operatively formed to engage with said knee support member when said knee support member is in the transverse position and said third pair of arms are in an extended position to form an arm rest for a patient seated on the chair, and when in the retracted and stored positions to lie substantially entirely within the plane of said elongated frame member.

7. The chair as claimed in claim 6 further including a pair of arms each pivotally mounted at one end on said first and second side members respectively of said elongated frame adjacent the opposite end of said side members from said first cross member, and a C shaped cross member fixed to the other ends of said pair of arms to form a face support for the patient.

8. The chair as claimed in claim 7 wherein padded cushions are removably attached to the seat, chest support, arm support, knee support and face support for increased comfort of the patient.

9. The chair as claimed in claim 8, wherein hook and loop fastening means are used to attach the padded cushions to the seat, chest support, arm support, knee supports and face support.

10. A unitary, portable and adjustable therapy chair on which a patient is seated to facilitate treatment by a therapist, said chair comprising:

a generally rectangular, elongated frame having first and side members, said side members being spaced apart and connected adjacent to one end by a first cross member, and at a longitudinal distance from said first cross member by a second cross member;

said side members forming at one end a first chair leg portion and at another end a head rest supporting portion;

a plurality, of pairs of two pivotally joined arms;

a first pair of two pivotally joined arms being pivotally fastened to said side members to form when in an erected position a second chair leg portion;

a second pair of two pivotally joined arms being pivotally fastened to said side members to form when in the erected position a patient seat portion; of a third pair of two pivotally jointed arms being pivotally fastened to said side members to form when in the elected position a patient arm rest portion;

said pairs of two pivotally joined arms being spaced along said first and second side members and spaced apart from each other to fold substantially flat within the plane of said frame when in a stored position.

11. The chair as claimed in claim 10 wherein said first pair of two pivotally joined arms are pivotally fastened to said frame to extend from one side of said frame when in the erected position and said second pair are pivotally fastened to said frame to extend from an opposite side of said frame members when in the erected position.

12. The chair as claimed in claim 10 wherein said plurality of pairs of two pivotally joined arms are pivotally fastened to each other and to said frame side members at each pivot point by a bolt and finger tightenable nut, whereby said chair may be set up for patient use and taken down without the use of any tools.

* * * * *